US006644394B1

(12) United States Patent
Kraft et al.

(10) Patent No.: US 6,644,394 B1
(45) Date of Patent: Nov. 11, 2003

(54) BRAZE ALLOY FLOW-BARRIER

(75) Inventors: Frank F. Kraft, Albany, OH (US); Dave W. Skrzypchak, Adrian, MI (US)

(73) Assignee: Brazeway, Inc., Adrian, MI (US)

( * ) Notice: Subject to any disclaimer, the term of this patent is extended or adjusted under 35 U.S.C. 154(b) by 0 days.

(21) Appl. No.: 10/183,099

(22) Filed: Jun. 25, 2002

(51) Int. Cl.[7] ..... F28F 1/20

(52) U.S. Cl. ..... 165/181; 179/183; 29/890.053; 138/38

(58) Field of Search ..... 165/181, 179, 165/183, 133; 138/38, 121, 173; 29/890.053, 890.054

(56) References Cited

U.S. PATENT DOCUMENTS 3,172,194 A * 3/1965 Pauls ..... 29/890.053
3,206,838 A * 9/1965 Pauls ..... 29/890.053
3,215,196 A * 11/1965 Pauls ..... 29/890.053
3,693,710 A * 9/1972 Drosnin ..... 165/152
6,056,048 A * 5/2000 Takahashi et al. ..... 165/184
6,173,762 B1 * 1/2001 Ishida et al. ..... 165/133
2002/0195233 A1 * 12/2002 Thors et al. ..... 165/133

FOREIGN PATENT DOCUMENTS

WO WO 00/70291 11/2000

* cited by examiner

*Primary Examiner*—Terrell McKinnon
(74) *Attorney, Agent, or Firm*—Harness, Dickey & Pierce, P.L.C.

(57) ABSTRACT

A heat exchanger tube of the present invention has first and second surfaces with a longitudinal length and a lateral width. At least one of the surfaces has a plurality of striae that extend along a portion of the width of the tube. The tube has at least one passageway that allows a fluid to flow therethrough. The striae minimize and/or prevent unwanted flow of molten braze alloy along die-lines in the tube formed as part of the extruding process. The striae can be formed in the tube by rollers having projections that extend radially outward. The projections form the striae in the tube as the tube passes along the outer surface of the roller. The striae can be advantageously formed in the tube as part of the overall extruding process or subsequent to the extruding of the tube during the sizing process.

33 Claims, 2 Drawing Sheets

BRAZE ALLOY FLOW-BARRIER

FIELD OF THE INVENTION

The present invention relates to heat exchangers, and more specifically, to heat exchanger tubes having braze alloy flow barriers. The invention also relates to a method of making the braze alloy flow barriers on the heat exchanger tube along with an apparatus for performing the method.

BACKGROUND OF THE INVENTION

During the manufacture of a heat exchanger, the heat exchanger tubes are typically attached to manifolds and/or fins by means of furnace brazing. A typical brazing operation is controlled atmospheric brazing. During controlled atmospheric brazing of aluminum heat exchangers, braze alloy that has been clad to various components (i.e., fin stock and manifolds) becomes molten and forms the required joints via flow by capillary forces. When the heat exchanger tubing is aluminum, dissolution and erosion of the aluminum tube walls can occur as a result of excessive molten braze alloy flowing along the tubes. The flow of molten braze alloy along the tube is facilitated by longitudinal die-lines. Die-lines are formed in the surface of the extruded tube during the extrusion process. These die-lines may be characterized as very small grooves that are a result of the tool (die)—tube interaction during the extrusion process. The die-lines extend longitudinally along the surface of the tube. Excessive flow of molten braze metal is generally undesirable, particularly when localized within a die-line or group of die-lines.

The braze alloy is a low melting temperature aluminum alloy that is typically high in silicon (7–13%). The brazing operation typically occurs at a temperature of approximately 600–615° C. During the brazing process, the silicon from the braze alloy will diffuse into the tube alloy and effectively lower its melting temperature at the surface. If excessive molten metal flow takes place in a concentrated region (such as along die-lines), the braze alloy will lower the temperature of the tube wall and allow it to melt and flow along with the molten braze alloy. Hence, as the tube wall is being dissolved by the braze alloy, the flow of the braze alloy erodes the tube wall. The erosion of the tube has consequences which can vary. For example, as a minimum the tube will lose thickness and in the worst case develop an opening through the tube into the passageways within the tube thus rendering the tube defective.

Therefore, excessive flowing of molten braze alloy along heat exchanger tubes is undesirable and can cause damage to the heat exchanger tubes. Therefore, it is desirable to minimize and/or prevent the flow of molten braze alloy along heat exchanger tubes during the furnace brazing process.

SUMMARY OF THE INVENTION

The present invention provides heat exchanger tubes that minimize and/or prevent concentrated and/or localized flow of braze alloy along the tube and/or die-lines during the brazing process. A heat exchanger tube according to the principles of the present invention has a plurality of striae in the surface of the tube that extend along a portion of the width of the surface. The plurality of striae interrupt and restrict the flow of molten braze alloy along the length of the tube. The striae thereby reduce the incidence of excessive tube wall erosion.

A heat exchanger tube with the plurality of flow barriers or striae can be fabricated by passing the tube along a cylindrical roller having an outer surface with a plurality of projections that extend radially outward from the surface. The projections form the plurality of striae on the tube as the surface of the tube is passed along the outer surface of the roller.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

Figure 1:
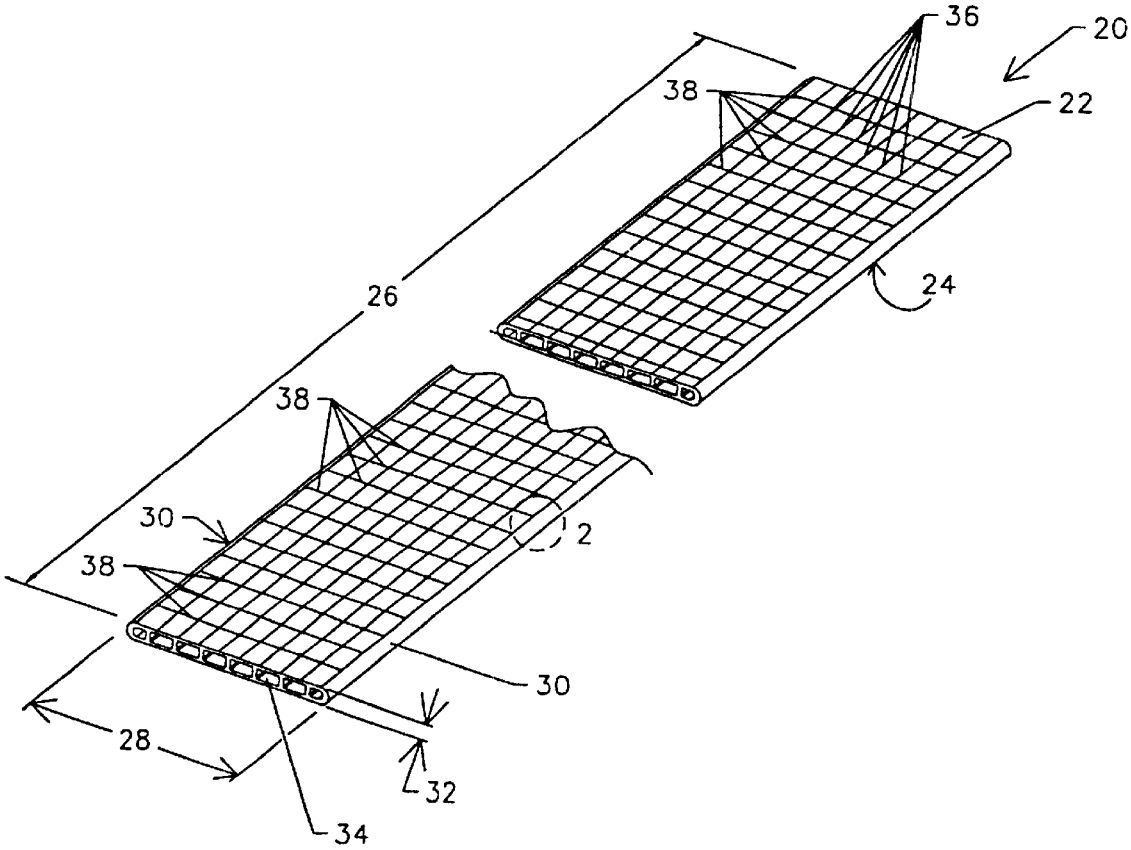
FIG. 1 is a perspective view of a heat exchanger tube having the flow barrier striae according to the principles of the present invention.

A heat exchanger tube 20 according to the principles of the present invention is shown in FIG. 1. The tube 20 has opposite first and second main heat transfer surfaces 22, 24. The first and second surfaces 22, 24 have a longitudinal length 26 and a lateral width 28. A pair of sidewalls 30 extend along the longitudinal length 26 and separate the first and second surfaces 22, 24. The sidewalls 30 define a thickness 32 of the tube 20. The tube 20 has at least one passageway 34 that extends the entire length 26. The passageway 34 allows a fluid, such as a refrigerant, to flow through the tube 20.

The tube 20 is typically formed by an extrusion process. During the extrusion process, the tooling (die)—tube 20 interaction can cause a plurality of longitudinal die-lines 36 in the surfaces 22, 24 of the extruded tube 20. The die-lines 36 are small grooves or channels that extend along the longitudinal length 26 (extruding direction). The die-lines 36 have a typical depth of about 5 to 20 micrometers. The die-lines 36 facilitate the flow of molten braze alloy along length 26 of the tube 20 which, as stated above, can cause erosion of the tube 20 during brazing. Subsequent to the extrusion process, the tube 20 can be cut to a desired predetermined length as it is being extruded, or it can be coiled to form a roll of tubing (not shown) that can later be flattened/sized (thickness 32 reduced to a predetermined value by passing the tube 20 between a pair of rollers), straightened and cut to a desired predetermined length as needed.

Figure 6:
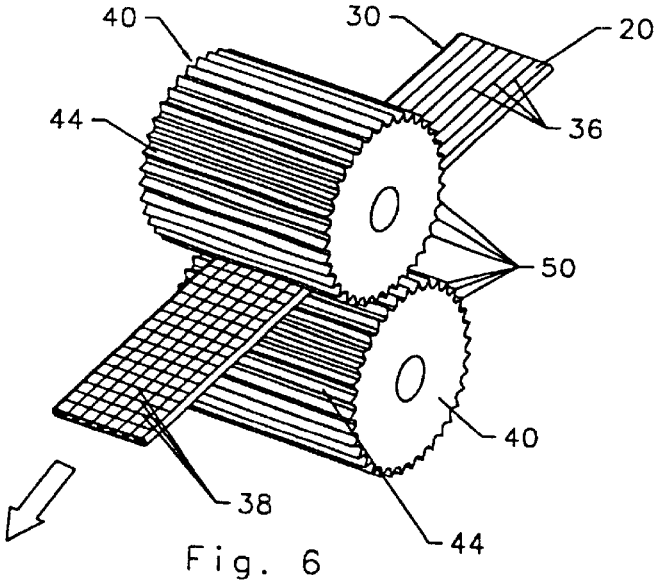
FIG. 6 is a perspective view of a pair of rollers making the flow barrier striae on a heat exchanger tube.
Figure 2:
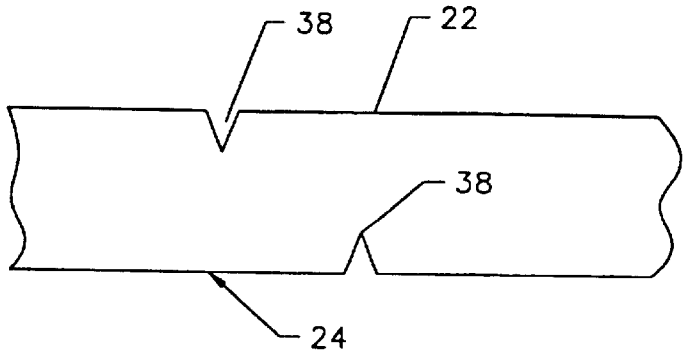
FIG. 2 is an enlarged exaggerated disproportionate view of a side profile of the heat exchanger tube of FIG. 1 taken within circle 2 showing a stria in two surfaces of the heat exchanger tube.

To impede and/or interrupt the flow of molten braze alloy along the die-lines 36, the tube 20, as can be seen in FIGS. 1, 2 and 6, has a plurality of striae (i.e., narrow grooves or channels) 38 that extend along the first and second surfaces 22, 24. The striae 38 extend linearly across the lateral width 28 of the first and second surfaces 22, 24 and are generally perpendicular to the die-lines 36. The striae 38 are spaced apart continuously along the entire longitudinal length 26 of the tube 20 so that there are striae 38 close to any point on the surfaces 22, 24 where brazing may occur. The striae 38 are generally parallel and equally spaced apart along the longitudinal length 26. Preferably, the striae 38 are spaced apart in the range of about 3–10 millimeters.

The striae 38, as shown in FIG. 2, taper as the striae 38 extend from the surfaces 22, 24 of the tube 20. The depth of the striae 38 can vary. Preferably, the striae 38 have a depth in the range of about 10–30 micrometers. The striae 38 on the first and second surfaces 22, 24 can be offset from one another, as shown in FIG. 2, or aligned. The striae 38 extend through and interrupt the die-lines 36 to thereby minimize and/or prevent unwanted and unnecessary flow of molten braze alloy along the die-lines 36 during the brazing process. That is, the small striae 38 interrupt and restrict the flow of molten braze alloy longitudinally along the surfaces 22, 24 of the tube 20 thereby reducing and/or preventing the incidence of tube erosion. The striae 38 are most effective at minimizing and/or preventing the flow of molten braze alloy along the die-lines 36 and/or length of the tube 20 when the depth of the striae 38 are greater than the depth of the die-lines 36. The use of a plurality of striae 38 helps ensure that excessive flow of braze alloy is inhibited by providing redundancy.

Figure 4:
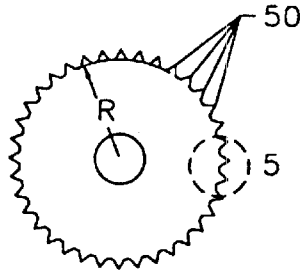
FIG. 4 is an end view of the roller of FIG. 3.
Figure 3:
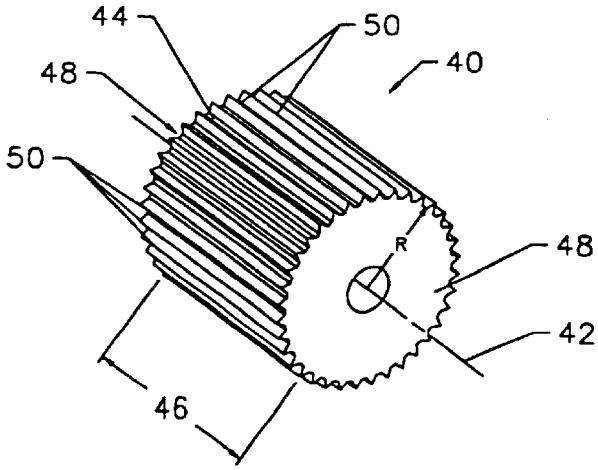
FIG. 3 is a perspective view of a roller that can be used to make the striae on the heat exchanger tube of FIG. 1.

Referring now to FIG. 3 and FIG. 4, a roller 40 is shown that can be used to make the striae 38 in the tube 20. The roller 40 is cylindrical and rotates about an axial axis 42. The roller 40 has an outer surface 44 with an axial width 46 that extends between ends 48 of the roller 40. The roller 40 has a radial radius R. There are a plurality of projections 50 on the outer surface 44 of the roller 40. The projections 50 extend linearly along the outer surface 44 generally parallel to the axial axis 42. The projections 50 extend along the entire axial width 46 of the roller 40 between the ends 48. The projections 50 are evenly spaced about the outer surface 44 of the roller 40. The number of projections 50 along the outer surface 44 can vary depending upon the desired spacing of the striae 38. The roller 40 is shown as having 36 projections 50 spaced along the outer surface 44 for clarity in illustrating the present invention. Preferably, the projections 50 are spaced along the outer surface 44 approximately every four degrees to yield a total of about 90 projections 50 around the circumference of the roller 40.

Figure 5:
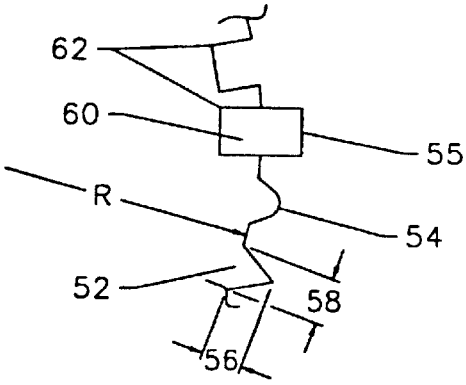
FIG. 5 is an exploded view of a portion of the end view of the roller of FIG. 4 taken within circle 5 showing the details of a few projections.

Referring now to FIG. 5, it can be seen that the projections 50 can take a variety of shapes. For example, the projections 50 can be acute, as shown on projection 52, blunt, as shown on projection 54, and/or flat, as shown on projection 55. The projections can vary in radial height 56 and width 58 depending on the desired size and shape of the striae 38 to be formed on the tube 20. Preferably, the projections 50 have a radial height 56 in the range of about 10–60 micrometers, with a typical radial height 56 of about 38 micrometers, and a width 58 (at the outer surface 44) of about 50 micrometers. The projections 50 can be formed integral to the roller 40, or preferably can be in the form of inserts 60, as shown in FIG. 5. Preferably, the inserts 60 fit within complementary channels 62 in the roller 40. The inserts 60 can be secured to the roller 40 in a variety of ways. For example, these ways include but are not limited to press fitting the inserts 60 into the channels 62, bonding the inserts 60 to the channels 62 with adhesives (not shown), and metallurgically attaching the inserts 60 to the roller 40. The inserts 60 are constructed from a material suitable for long wear, such as carbide, tool steel, and ceramic. The inserts 60 can be preformed with the desired projection shape or can be ground to the desired shape after being attached to the roller 40.

As was stated above, the roller 40 can be used to make the striae 38 in tube 20, as shown in FIG. 6. The striae 38 are formed by passing the first and/or second surfaces 22, 24 of the tube 20 along one or more rollers 40. The tube 20 shown in FIG. 6 has striae 38 being formed in both the first and second surfaces 22, 24. The rollers 40 pinch the tube 20 as it passes therebetween to cause the projections 50 to press into the surfaces 22, 24 as the tube 20 passes therethrough. The force of the projections 50 on the first and second surfaces 22, 24 causes the striae 38 to be formed therein.

The striae 38 can be formed on the tube 20 at various stages of fabrication of the tube 20. For example, the striae 38 can be formed in the first and/or second surfaces 22, 24 as the tube 20 is being extruded by passing the tube 20 after exiting the extruder dies between the rollers 40 wherein the projections 50 will cause the striae 38 to be formed on the first and/or second surfaces 22, 24. The tube 20 can then be cut to a desired predetermined length or coiled into a roll for use later. Alternatively, the striae 38 can be formed in the tube 20 after the tube 20 has been extruded. For example, as stated above, when the tube 20 is extruded, it may be coiled into a roll of tubing that is later flattened/sized, straightened, and cut to desired predetermined lengths. The sizing process typically occurs before the straightening and cutting processes. During the sizing process, the tube 20 typically passes between a pair of rollers that are used to establish the thickness 32 of extruded tube 20 to a desired value. The rollers used in the sizing process can be modified by providing the sizing rollers with projections 50 so that the striae 38 are formed in the first and/or second surfaces 22, 24 during the sizing process. The tube 20 can then be straightened and cut to the predetermined length. The integration of the forming of the striae 38 in the first and/or second surfaces 22, 24 into the fabrication process of extruding or of sizing the tube 20 allows the striae 38 to be formed in the tube 20 economically.

The orientation and configuration of the projections 50 on the rollers 40 will determine the orientation and configuration of the striae 38 on the first and second surfaces 22, 24 of the tube 20. For example, if the projections 50 extend linearly along the outer surface 44 of the roller 40, the striae 38 formed in the tube 20 will also be linear. Additionally, the spacing of the projections 50 about the roller 40 will affect the spacing of the striae 38 on the tube 20. Therefore, the orientation and configuration of the striae 38 formed in the tube 20 can be altered by altering the orientation and configuration of the projections 50 on the rollers 40, as will be apparent to one skilled in the art.

Alternatively, instead of using rollers to form the striae 38 on the first and second surfaces 22, 24 of the tube 20, a stamping process can be used. The tube 20 can be passed through a stamping process wherein dies (not shown) are used to stamp the striae 38 into the first and/or second surfaces 22, 24 of the tube 20. The striae 38 can also be formed in the tube 20 by scratching or scribing the striae 38 into the tube 20.

While the preferred embodiment has been described above with reference to specific configurations and orientations for the striae 38, it should be understood that variations can be made to the configuration and orientation without departing from the scope of the invention as defined by the claims. For example, the striae 38 can be curved or nonlinear. The striae 38 can form a pattern on the tube 20, such as a herringbone or wavy pattern. The striae 38 are also not required to be generally perpendicular to the die-lines 36. The striae 38 do not need to be parallel to each other nor equally spaced apart along the longitudinal length 26. While the striae 38 are shown as occurring continuously along the length 26, the striae 38 do not need to be continuous to be within the scope of the invention. The striae 38 have also been described with preferred spacing and depths, however, other spacings and depths can be employed depending upon the application within which the tube 20 will be employed. Therefore, it should be understood that these and other deviations from the preferred embodiment are within the scope of the invention as defined by the claims.

Likewise, the roller 40 has been described as having projections 50 with specific configurations and orientations. However, it should be understood that other configurations and orientations of the projections 50 can be employed without departing from the scope of the invention as defined by the claims. For example, the projections 50 can extend in a curved or nonlinear manner along the outer surface 44 of the roller 40. Additionally, the projections 50 do not need to be parallel to the axial axis 42 nor do they need to be evenly spaced apart about the circumference of the roller 40. Additionally, the projections 50 do not need to extend along the entire axial width 46 of the rollers 40. Furthermore, the projections 50 on roller 40 do not all need to be the same type or style of projections 50. Rather, the projections 50 on roller 40 can be a combination of the various configurations and orientations depending upon the desired configuration and orientation of striae 38 to be formed on tube 20. These and other configurations and orientations can be employed to make striae 38 that minimize and/or prevent the unwanted flow of molten braze alloy along the tube 20 and are within the scope of the invention as defined by the claims.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An extruded heat exchanger tube comprising:

opposite first and second surfaces with a longitudinal length and a lateral width, at least one of said first and second surfaces having at least one die-line and having a plurality of striae along said length, said striae extending along a portion of said width, and at least one of said striae intersecting said die-line; and at least one passageway extending along said length between said surfaces such that fluid is allowed to flow therethrough.

2. The tube of claim 1, wherein said striae are longitudinally equally spaced apart along said length.

3. The tube of claim 2, wherein said striae are continuously longitudinally equally spaced apart along an entire length of said at least one of said first and second surfaces.

4. The tube of claim 1, wherein each of said striae extends along an entire width of said at least one of said first and second surfaces.

5. The tube of claim 1, wherein said striae are parallel.

6. The tube of claim 1, wherein said striae extend linearly along said portion of said lateral width.

7. The tube of claim 1, wherein said striae extend laterally along said portion of said lateral width.

8. The tube of claim 1, wherein said striae taper as said striae extend from said at least one of said first and second surfaces toward said at least one passageway.

9. The tube of claim 1, wherein both of said first and second surfaces include said plurality of striae.

10. The tube of claim 1, wherein said striae have a depth in the range of about 10–30 micrometers.

11. The tube of claim 1, wherein said striae are longitudinally spaced apart in the range of about 3–10 millimeters.

12. The tube of claim 1, wherein said at least one die-line has a depth and said at least one stria intersecting said die-line has a depth at least as large as said depth of said die-line.

13. A heat exchanger tube comprising:

an outer surface;

at least one passageway;

at least one die-line extending along a portion of said outer surface; and a plurality of striae along said outer surface with at least one of said striae intersecting said die-line.

14. The heat exchanger tube of claim 13, wherein said at least one die-line is a plurality of die-lines.

15. The heat exchanger tube of claim 13, wherein said striae are equally spaced apart along said outer surface.

16. The heat exchanger tube of claim 13, wherein said at least one stria orthogonally intersects said die-line.

17. The heat exchanger tube of claim 13, wherein said outer surface includes opposite first and second surfaces and striae extend along both of said first and second surfaces.

18. The heat exchanger tube of claim 13, wherein said die-line has a depth and said at least one stria intersecting said die-line has a depth at least as large as said depth of said die-line.

19. The heat exchanger tube of claim 13, wherein said striae have a depth in the range of about 10–30 micrometers.

20. The heat exchanger tube of claim 13, wherein said die-line has a depth in the range of about 5–20 micrometers.

21. A method of making a heat exchanger tube with a plurality of flow barriers comprising the steps of:

providing a tube having opposite first and second surfaces, at least one die-line on at least one of said surfaces, and at least one fluid passageway; and forming a plurality of striae along a portion of a longitudinal length of at least one of said first and second surfaces, said striae extending across a portion of a lateral width of said at least one of said first and second surfaces and at least one of said striae intersecting said die-line.

22. The method of claim 21, wherein said step of providing said tube includes extruding said tube.

23. The method of claim 22, wherein said step of forming striae includes passing said tube along a roller that forms said striae on said at least one of said first and second surfaces as said tube is extruded.

24. The method of claim 21, wherein said step of forming striae includes passing said tube along a roller that forms said striae on said at least one of said first and second surfaces.

25. The method of claim 24, wherein said step of forming striae includes passing said tube between a pair of rollers that form said striae on said first and second surfaces.

26. The method of claim 21, further comprising the step of sizing said tube to a predetermined thickness and wherein said step of forming striae is performed concurrently with said step of sizing said tube.

27. The method of claim 21, wherein said step of forming striae includes forming striae that extend laterally across said portion of said lateral width of said surfaces.

28. The method of claim 21, wherein said step of forming striae includes evenly longitudinally spacing said striae along said longitudinal length.

29. The method of claim 21, wherein said step of forming said striae includes stamping said striae in said at least one of said first and second surfaces.

30. The method of claim 21, wherein said portion of said longitudinal length is an entire longitudinal length of said at least one of said first and second surfaces.

31. The method of claim 21, wherein said step of forming striae includes forming parallel striae.

32. The method of claim 21, wherein said step of forming striae includes forming linear striae.

33. The method of claim 21, wherein said step of forming striae includes forming said striae with a depth at least as large as a depth of said die-line.

* * * * *